United States Patent [19]

Jahoda

[11] 4,173,998

[45] Nov. 13, 1979

[54] FORMED COIL ASSEMBLY

[75] Inventor: John Jahoda, McMinnville, Tenn.

[73] Assignee: Carrier Corporation, Syracuse, N.Y.

[21] Appl. No.: 878,195

[22] Filed: Feb. 16, 1978

[51] Int. Cl.[2] ..... B23P 15/26

[52] U.S. Cl. ..... 165/182; 29/157.3 V; 29/157.3 A; 29/157.3 B; 113/118 B; 165/150; 165/151; 113/118 V

[58] Field of Search ..... 29/157.3 A, 157.3 B, 29/157.3 C, 157.3 V; 165/150, 151, 182; 113/118 A, 118 B, 118 C, 118 V

[56] References Cited

U.S. PATENT DOCUMENTS

| | | | |
|---|---|---|---|
| 1,984,938 | 12/1934 | Mason et al. | 29/157.3 A |
| 2,173,666 | 9/1939 | Sibley | 29/157.3 B |
| 2,298,895 | 10/1942 | McKibben et al. | 113/118 B X |
| 2,994,123 | 8/1961 | Kritzer | 29/157.3 |

FOREIGN PATENT DOCUMENTS

| | | | |
|---|---|---|---|
| 597464 | 8/1925 | France | 165/151 |
| 839333 | 6/1960 | United Kingdom | 29/157.3 B |

*Primary Examiner*—Francis S. Husar
*Assistant Examiner*—V. K. Rising
*Attorney, Agent, or Firm*—J. Raymond Curtin; Robert P. Hayter

[57] ABSTRACT

Apparatus and a method of manufacturing a formed coil having multiple single row coil cores of varying lengths. Sheets of fins are cut from plate fin stock such that the fins within each sheet are connected to each other by rupturable tabular portions. The sheets of fins are then arranged in registration such that openings within the fins for the receipt of tubes are aligned and tubular members or hairpins may be inserted within the fins to form part of the fluid flow circuit of the coil. Since the hairpins for adjacent coil rows are of different lengths, when the multiple row coil core is bent each coil row is formed about a separate radius curvature so that the formed coil will be in the desired configuration. Prior to bending, the hairpins are expanded to form a heat transfer bond with the fins, the expansion process acting to rupture the tabular portions connecting the fins such that the fins on the hairpins become separately spaced along each hairpin. Thereafter the coil core is bent to the desired formed coil configuration wherein the fins are spaced distinctly along each coil row notwithstanding that the fins were originally from the same sheet and connected to each other by the tabular portions.

9 Claims, 6 Drawing Figures

FORMED COIL ASSEMBLY

BACKGROUND OF THE INVENTION

1. Field of the Invention

The present invention relates to heat exchangers which are adapted to transfer heat energy between a fluid flowing through a tube and a gas in contact with the plate fins of the coil. More particularly, the present invention applies to heat exchanger coils particularly known as plate fin coils for use in the air conditioning and refrigeration industry. Typically these coils have refrigerant flowing through a circuit formed by tubular members and air flowing over the plate fins connected to the tubular members.

2. Description of the Prior Art

Formed coils are often used in the refrigeration and air conditioning industry when a heat exchanger coil is desired that will fit within a small container and yet must be of sufficient size that a single pass within the container will be insufficient to meet the load requirements of the unit. Many heat pump applications involve the use of an outdoor coil wherein the coil is either circular, L-shaped or U-shaped and wherein multiple row coils are necessary. This multiple row coil is usually arranged such that the first row of the coil is adjacent to the source of gaseous material to which or from which heat is to be transferred and the other rows of the coil are located interior thereof. Consequently, to fit this multiple row coil within the particular enclosure it is necessary that the radius of curvature of the bends in the interior coil be less than that of the exterior coil. Consequently, if two coils of the same length are bent on a different radius of curvature the ends of the coils will not be flush, resulting in uneven heat transfer characteristics. To overcome this problem, formed coils have been built of varying coil row lengths. Using a two roll coil for example the exterior coil is designed to have a greater length than the interior coil consequently, both coils will extend between the same locations and the desired heat transfer characteristics for the unit will be achieved.

The construction of previous formed heat exchangers involved forming a stack of fins for each coil row, lacing the fins with the appropriate length tubing, installing a tube sheet which fits the ends of the coil rows, inserting return bends to complete the fluid flow circuit through the tubes and thereafter assembling and bending both coils. The shorter coil is bent about a smaller radius of curvature than the longer coil so that the previously uneven coil ends are even after bending. This process involves the actual assembly of two or more separate coils and subsequent joining.

The present invention by the use of sheets of fins connected by rupturable tabular portions allows simultaneous lacing of the longer hairpins of the exterior coil and the shorter hairpins of the interior coil. The longer hairpins after the lacing operation obviously extend further from the fin pack than the shorter hairpins. The common tube sheet at the end of the fin pack furthest from the curvilinear part of the hairpins has been mounted prior to the lacing such that when the lacing operation occurs the hairpins are also inserted through the tube sheet. The coil rows are then expanded such that the diameter of the hairpins are increased to form a tight fit with the fins. During this expansion the tabular portions connecting the fins within the sheets are ruptured such that the fins of a sheet may be displaced in relation to each other to be evenly spaced along the respective hairpins. Mechanical expansion with "bullets" (expansion elements) further serves to space the fins along the hairpins as a result of the travel direction of the "bullets" downward thru the hairpins. The displacement results in the fins being separately spaced along the length of each hairpin. The coil rows are then bent to the desired configuration such that the hairpins curvilinear part ends in the desired location. A method has been provided for the assembly of formed coils which allows the short and long hairpins to be simultaneously laced and thereafter for even distribution of the fins within both the short and long coil rows without the necessity of individually assembling and forming each row.

SUMMARY OF THE INVENTION

An object of the present invention is to manufacture a formed plate fin coil assembly.

Another object of the present invention is to provide a method for simultaneously forming all the rows of a formed coil.

A further object of the present invention is to provide a formed coil wherein sheets of fins are arranged such that at least a portion of said sheets of fins are separated into individual fins during the step of expansion.

Another object of the present invention is to provide a heat exchanger suitable for use in air conditioning and refrigeration equipment wherein multiple coil rows bent at different radii of curvature are utilized.

A still further object is to provide a cheap, economical, efficient and reliable method of manufacturing plate fin heat exchanger coils.

Other objects will be apparent from the description to follow and from the appended claims.

The preceding objects are achieved according to preferred embodiment of the invention by the provision of sheets of fins, the fins of each sheet being connected to each other by rupturable tabular portions. A fin pack formed from a myriad of sheets is arranged in registration such that the hairpin tubes may be inserted through the openings contained within the fins. Separate coil rows are formed with at least one coil row having a different length from another coil row such that after bending the separate coil rows are formed with separate radii of curvature such that a relative displacement of a part of the fins of one coil row relative to the other coil row occurs. During expansion of the hairpins to the fins the tabular portions connecting the fins of the sheet are ruptured and the fins spaced evenly along each of the hairpins.

DESCRIPTION OF THE PREFERRED EMBODIMENT

The embodiment of the invention described below is adapted for use in air conditioning and refrigeration equipment although it is to be understood that formed plate fin heat exchanger coils find like applicability in other forms of heat transfer arrangements. The method of making formed coils described herein may be utilized for all types of plate fin coils. The specific embodiment that will be described refers to formed coils for use in an outdoor coil of a heat pump or the condenser coil of an air conditioner. It is to be understood that even within the air conditioning and refrigeration industry formed coils take on a multiplicity of shapes and dimensions, and are formed with different numbers of rows, different heights and other varying features.

Figure 1:
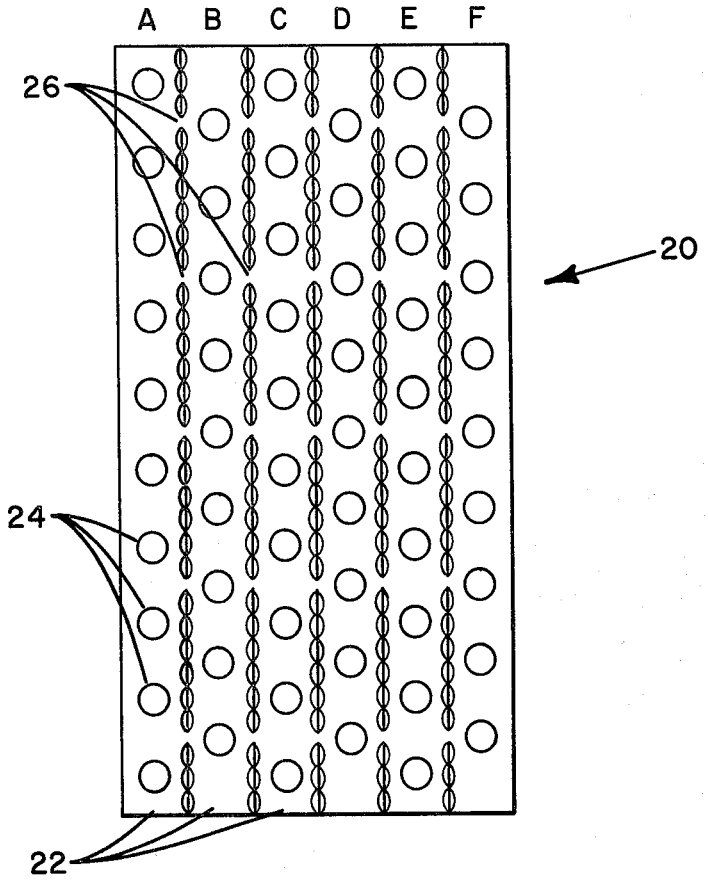
FIG. 1 is a top view of a fin sheet.
Figure 2:
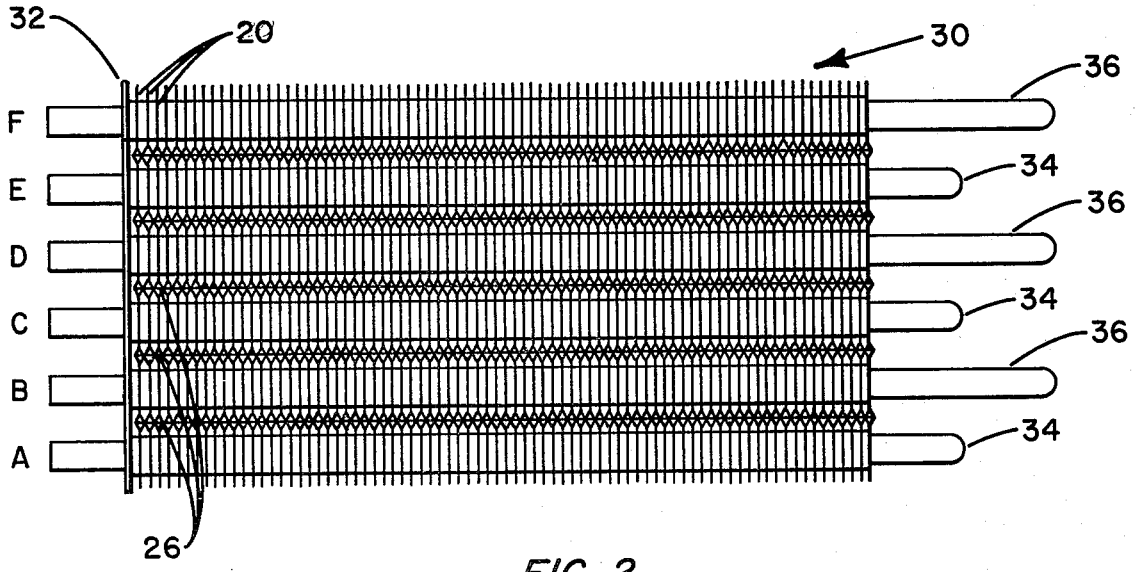
FIG. 2 is a top view of a plate fin bundle laced with alternating short and long return bends.

Referring now to the drawings, FIG. 1 is a top view of a fin sheet wherein fins 22 denoted as A through F are manufactured from plate fin stock in a desired configuration. Tabular portions 26 connect fins A through F to form fin sheet 20. Each fin has openings 24 for the receipt of tubular members. In FIG. 2, a top view of a plate fin bundle, a multiplicity of fin sheets 20 are shown arranged in registration such that hairpins 34 and 36 may be laced therethru and through tube sheet 32. It is obvious from the drawing that hairpins 34 are shorter in length than hairpins 36. It can also be seen in the drawing that tabular portions 26 separate coil rows A, B, C, D, E and F formed by a multiplicity of fins A, B, C, D, E and F from the various fin sheets. Fin sheets 20 are so arranged that an application of force may separate the tabular portions between fin rows such that partially assembled coil cores are separated from the remainder of the coil bundle 30.

Figure 3:
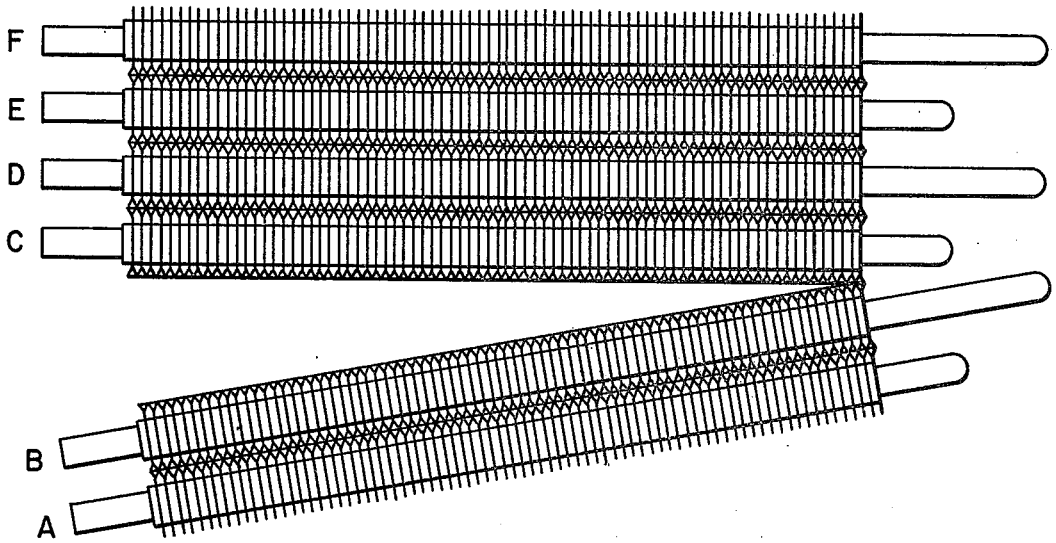
FIG. 3 is a top view of the plate fin bundle of FIG. 2 wherein coil rows A and B have been separated from the remainder of the plate fin bundle.
Figure 4:
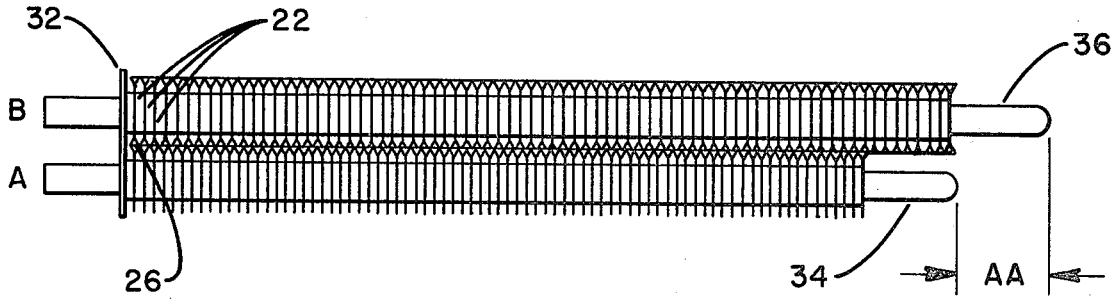
FIG. 4 is a top view of a two row coil prior to bending.

In FIG. 3, a top view of a plate fin bundle with two coil rows separated, it is obvious that a force has been applied and that the tabular portions 26 between coil bundle rows B and C have been broken such that a partially assembled two row coil core having coil rows A and B is separated from coil bundle 30. This two row coil core is shown in top view in FIG. 4 after it has been expanded, the expansion acting to evenly space the fins along each tube as is more particularly described in the fourth paragraph hereinabove. Therein it can be seen that hairpin 34 is considerably shorter than hairpin 36. The difference in length between the two hairpins is designated as distance AA. In FIG. 4, tube sheet 32 is parallel with fins 22 of fin sheets 20. FIG. 5 shows the same coil again after it has been expanded so that the tubular portions are ruptured and the fins evenly spaced along each hairpin and then bent to the desired configuration. Therein it can be seen that coil row B is bent around a larger radius curvature than coil row A, consequently, although coil row B is longer in length than coil row A both terminate at the same position such that the ends of hairpins 34 and 36 are even. The greater distance along the larger radii of curvature of coil row B is equivalent to distance AA in FIG. 4, consequently, the hairpins 34 and 36 both terminate at the same point. It can be further seen, in FIG. 5, that the individual fins in coil rows A and B are affected by the expansion operation. Some of the tabular portions 26 connecting individual fins A to fins B are ruptured. It can be seen in the drawing that tabular portions 26 for the first part of the coil core where no relative displacement has occurred remain connected, and for the part of the coil core where relative displacement has occurred the tabular portions 26 are ruptured during the expansion process and the A fins move relative to the B fins such that the fins are spacedly dispersed along both return bends over the remaining length of the return bends. If some of the tabular portions are not ruptured as desired during the expansion step they may later be ruptured by hand or otherwise.

Figure 5:
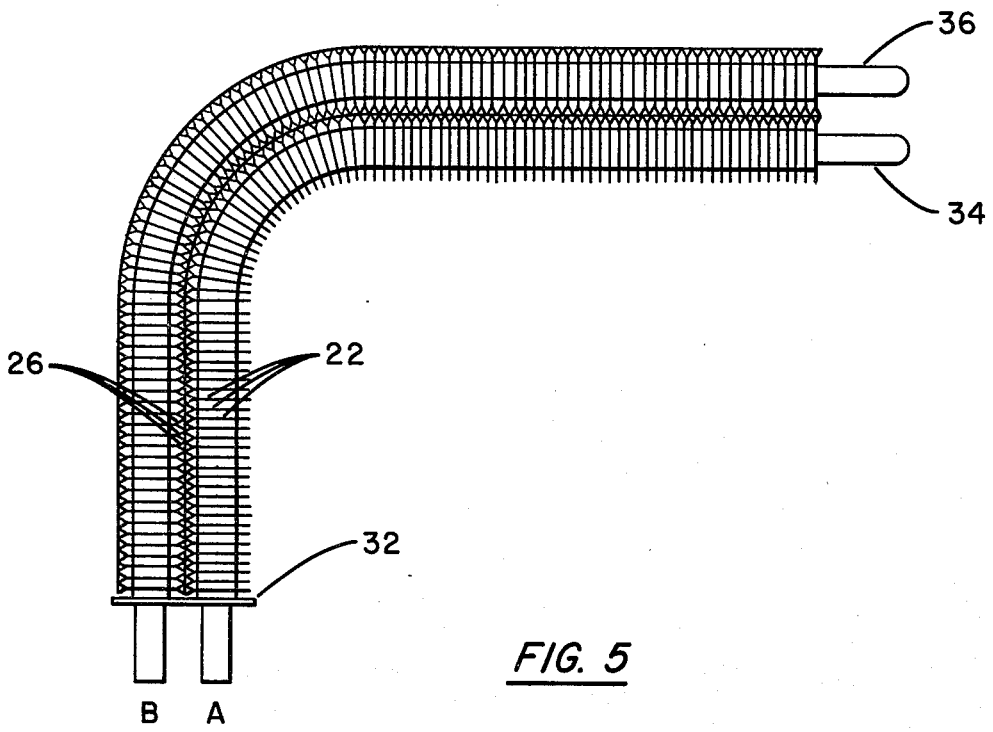
FIG. 5 is a top view of a two row coil bent at a right angle.
Figure 6:
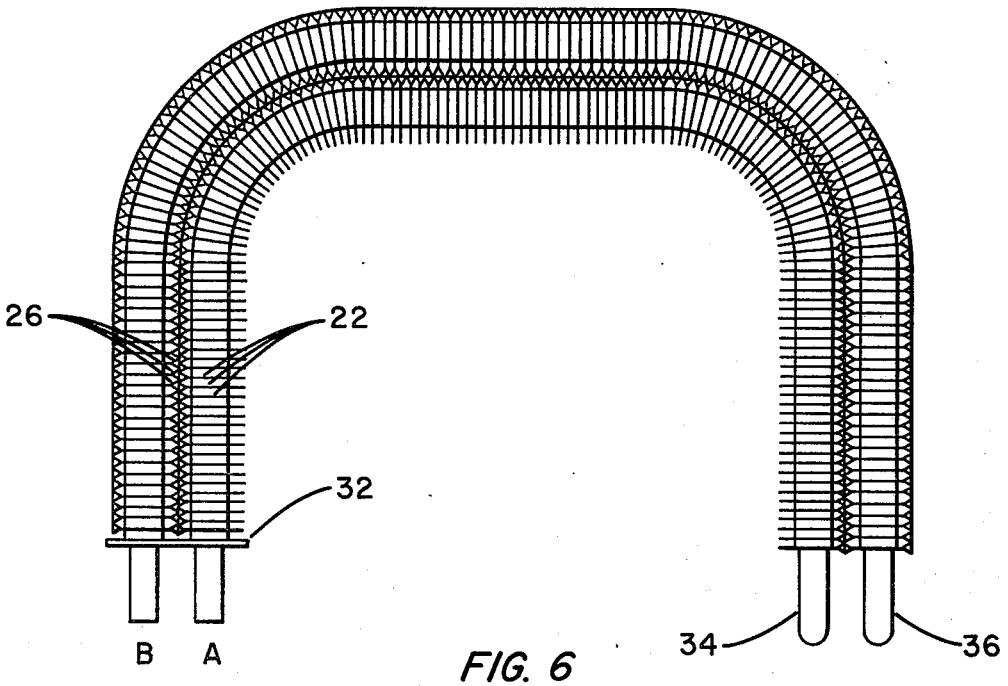
FIG. 6 is a top view of a U-shaped coil after bending.

FIG. 6 shows a separate embodiment of the formed coil utilizing the same principles as in FIG. 5. In FIG. 6 the coil is bent in a U-shape again with hairpin 34 being on the interior and hairpin 36 on the exterior. The final coil shape formed from a coil having differing length hairpins is selected such that the ends of both hairpins end up being in a common or equal position.

For a more particular description as to the use of fin sheets having fins connected by tabular portions and thereafter separating coil rows from a coil bundle formed of these fin sheets reference is made to U.S. patent application entitled, "Plate Fin Coil Assembly", Ser. No. 878,059 and assigned to the assignee hereof.

It is to be understood that the description above is merely illustrative and that many embodiments of formed coils are possible.

The invention has been described in detail with particular reference to preferred embodiment thereof, but it will be understood that variations and modifications can be effected within the spirit and scope of the invention.

I claim:

1. A method of manufacturing a formed coil having multiple single row coil cores of varying lengths such that when the coil is bent to the desired shape the coil rows will be in the appropriate location which comprises the steps of:

arranging in registration a plurality of sheets of plate fins, said fins having openings to receive tubular members and said fins being joined by at least one break away tabular portion such that upon an application of force the individual fins of the sheet may be separated;

lacing the sheets of plate fin by inserting tubes through the fin openings such that the fins are spaced along the tubes, said tubes being of varying length depending upon the final coil configuration desired;

expanding the tubes to form a tight fit between the fins and tubes, at least a part of the tabular portions connecting the fin sheets being ruptured during expansion such that said fins are spaced along the tubes of each coil core independently of the spacing of the fins along the adjacent coil core; and bending the coil cores to the desired configuration.

2. The invention as set forth in claim 1 and further including the step of:

joining an end of each coil core to the other coil core to provide for fluid communication between the tubes of each coil core of the formed coil.

3. A method of manufacturing a formed heat exchanger coil having multiple single row coils of varying lengths such that when a coil is bent to a desired shape the coil rows will be in the appropriate location which comprises the steps of:

stacking a plurality of sheets of connected plate fins, said fins being joined to each other by break away tabular portions and said fins having openings for the receipt of tubular members;

lacing the sheets of plate fins by inserting the tubular legs of the hairpin tubes through the fin openings, the length of the legs of each hairpin tube being dependent on the final configuration of the desired coil cores;

expanding the single row coil cores to enhance heat transfer between the tubes and fins, said expansion acting to rupture the tabular portions joining the individual fins within the sheets of plate fin thereby allowing the fins to be separately spaced along each coil core; and bending the coil cores to the desired configuration.

4. The invention as set forth in claim 3 further including the step of:

assembling the coil cores by aligning the ends of the hairpin tubes protruding from each coil core, locating a common tube sheet for all the coil cores, and joining the appropriate hairpin tubes to each other with return bends to complete the desired fluid circuit within the coil.

5. A formed coil having multiple single row coil cores of varying lengths which comprises:

a first coil core having fins spaced along tubes; and a second coil core of a different length than the first coil core and also having fins spaced along the length thereof, the fins in the first and second coil core having been made from sheets joined by tabular portions such that when the tubes were expanded to enhance heat transfer between the fins and the tubes, at least a part of the tabular portions were ruptured during the expansion so that fins from the sheets that were joined by the tabular portions are spaced dissimilarly along the coil cores.

6. The invention as set forth in claim 5 wherein at least one sheet having a fin in the first coil core connected by tabular portions to the fin in the second coil core remains attached during expansion such that the formed coil has coil cores with connected fins.

7. The invention as set forth in claim 5 wherein the first coil core and the second coil core are joined on one end by a common tube sheet.

8. A heat exchanger which comprises sheets of fins, the individual fins of the sheets being attached to adjacent fins by tabular portions and said fins having openings sized to receive tubes, and tubes of varying lengths inserted through the openings to form coil cores of varying lengths, the tubes being expanded to increase heat transfer between the tubes and the fins such that the fins on each are displaced relative to each other, a part of the fins of the sheets being separated at the tabular portions to form the heat exchanger, and the coil cores being bent about separate radii of curvature to the desired configurations.

9. The invention as set forth in claim 8 wherein the coil cores are joined at one end by a common tube sheet and the tubes in the coil cores are connected to form fluid flow paths through the coil cores of the heat exchanger.

* * * * *